US011809119B2

(12) United States Patent
Hirabayashi

(10) Patent No.: US 11,809,119 B2
(45) Date of Patent: Nov. 7, 2023

(54) POWER SUPPLY APPARATUS AND IMAGE FORMING APPARATUS

(71) Applicant: CANON KABUSHIKI KAISHA, Tokyo (JP)

(72) Inventor: Jun Hirabayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/532,940

(22) Filed: Nov. 22, 2021

(65) Prior Publication Data

US 2022/0171321 A1 Jun. 2, 2022

(30) Foreign Application Priority Data

Nov. 27, 2020 (JP) ..... 2020-197070

(51) Int. Cl.
*G03G 15/00* (2006.01)

(52) U.S. Cl.
CPC ..... *G03G 15/80* (2013.01)

(58) Field of Classification Search
CPC ..... G03G 15/80
USPC ..... 399/88
See application file for complete search history.

(56) References Cited

U.S. PATENT DOCUMENTS

2008/0055862 A1* 3/2008 Yu ..... H01L 23/4006 257/E23.084
2012/0134707 A1* 5/2012 Inukai ..... G03G 15/80 363/21.17
2019/0307013 A1* 10/2019 Hashizume ..... H05K 7/2039

FOREIGN PATENT DOCUMENTS

JP 2004172371 A 6/2004
JP 2008306779 A 12/2008
JP 2013246398 A 12/2013

* cited by examiner

*Primary Examiner* — Quana Grainger
(74) *Attorney, Agent, or Firm* — Canon U.S.A., Inc. I.P. Division

(57) ABSTRACT

A power supply apparatus includes a transformer including primary and secondary coils, a heatsink that radiates heat, and a substrate supporting the heatsink and including primary and secondary circuits. The transformer outputs a voltage to the secondary coil according to a voltage input to the primary coil. The heatsink includes a protruding portion protruding from a position where the heatsink is in contact with the substrate in a direction protruding from a surface of the substrate. The heatsink further includes an extending portion extending from part of the protruding portion to an area of the secondary circuit of the transformer, in a state spaced apart from the substrate. The extending portion enters the area of the secondary circuit when viewed in a direction perpendicular to the surface of the substrate. A distance between the extending portion and the surface of the substrate is longer than at least 1 millimeter (mm).

18 Claims, 7 Drawing Sheets

FIG. 6A
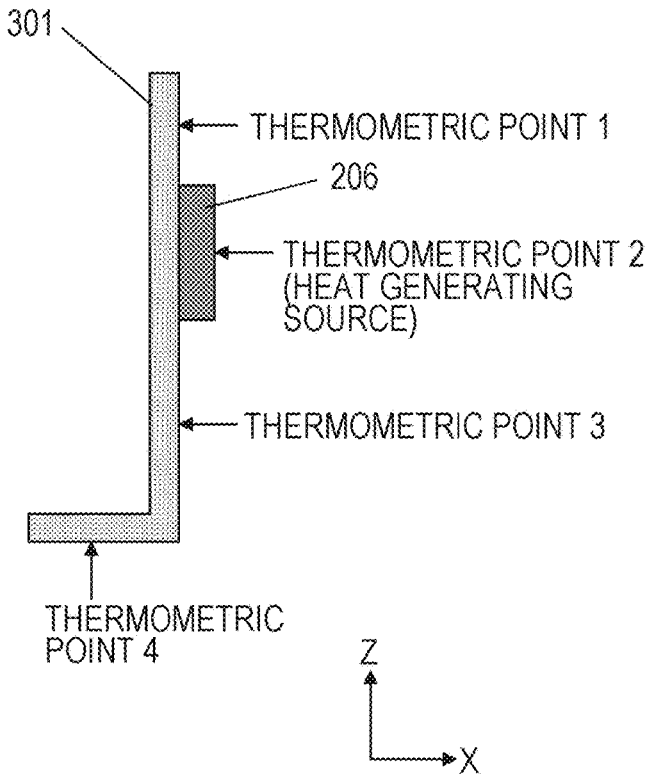
FIG. 6B
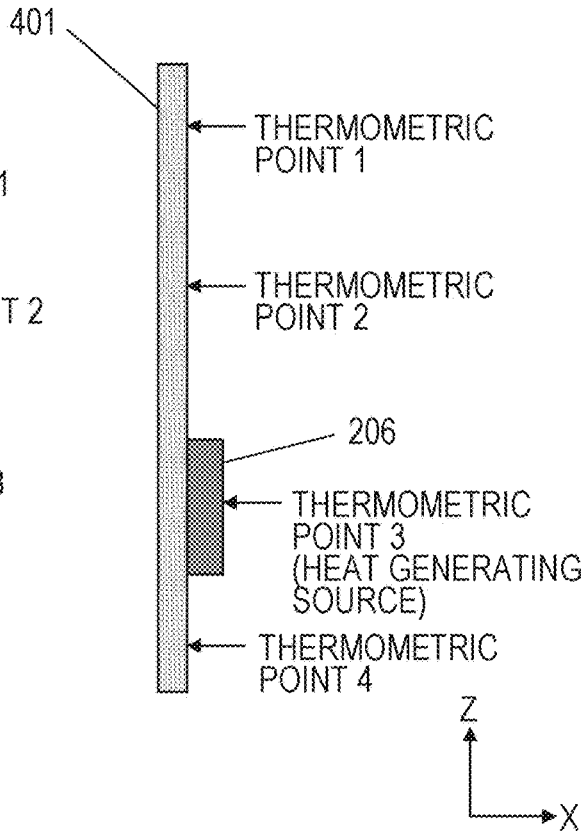
FIG. 6C
| | FIG. 6A | FIG. 6B |
|---|---|---|
| THERMOMETRIC POINT 1 | 77.6°C | 67.5°C |
| THERMOMETRIC POINT 2 | **82.9°C** | 74.6°C |
| THERMOMETRIC POINT 3 | 70.1°C | **79°C** |
| THERMOMETRIC POINT 4 | 66.4°C | 76.6°C |

POWER SUPPLY APPARATUS AND IMAGE FORMING APPARATUS

BACKGROUND

Field

The present disclosure relates to a power supply apparatus including a heatsink for radiating heat and an image forming apparatus including the power supply apparatus.

Description of the Related Art

Image forming apparatuses, such as laser printers, include a power supply apparatus that rectifies and smooths a commercial alternating current to convert it to a direct current. A switched-mode power supply, which is a type of direct-current power supply, inputs a rectified smoothed direct current to a transformer for switching, thereby providing a desired output. Example methods for the switched-mode power supply include a flyback method, a forward method, and a current resonant method. These switched-mode power supplies include a heatsink on a substrate to radiate heat mainly generated from a switching element.

Japanese Patent Laid-Open No. 2013-246398 discloses a configuration in which a power supply board in which a low-voltage supply circuit and a high-voltage supply circuit are connected into one and a control board including a main control circuit are layered. The space between the power supply board and the control board is provided with a shield plate for preventing radiated emission to prevent radiated emission from the low-voltage supply circuit and the high-voltage supply circuit from influencing the operation of the main control circuit. The low-voltage supply circuit includes a heatsink. The heatsink is connected to the shield plate so that the shield plate also functions as a heatsink. This improves the heat radiation efficiency of electronic components such as a switching element.

The configuration disclosed in Japanese Patent Laid-Open No. 2013-246398 is effective in the case where the power supply board and the control board are layered but is inapplicable in the case where the shield plate is not needed, for example, when the control board is disposed at another location. To improve the heat radiation efficiency of the electronic components without the shied plate, the heatsink may be simply increased in size.

The heatsink of the low-voltage supply circuit is often disposed near the switching element, that is, at the primary circuit of the transformer. Since the primary circuit and the secondary circuit are isolated from each other by the transformer, the heatsink disposed at the primary circuit cannot be brought into the area of the secondary circuit. For that reason, increasing the size of the heatsink requires devising the circuit configuration so that the heatsink falls within the area of the primary circuit. If the heatsink does not fall within the area, the area of the substrate needs to be increased to increase the area of the primary circuit.

SUMMARY

The present disclosure increases the size of the heatsink without increasing the area of the substrate, thereby improving the heat radiation efficiency of electronic components.

A power supply apparatus according to an aspect of the present disclosure includes a transformer including a primary coil and a secondary coil, the transformer outputting a voltage to the secondary coil according to a voltage input to the primary coil, a heatsink configured to radiate heat of the power supply apparatus, and a substrate including a primary circuit with the primary coil and a secondary circuit with the secondary coil on the same plane, wherein the substrate is in contact with the heatsink in an area of the primary circuit to support the heatsink, wherein the heatsink includes a protruding portion protruding from a position where the heatsink is in contact with the substrate in a direction protruding from a surface of the substrate and an extending portion extending from part of the protruding portion to an area of the secondary circuit of the transformer, in a state spaced apart from the substrate, and wherein the extending portion enters the area of the secondary circuit when viewed in a direction perpendicular to the surface of the substrate, and a distance between the extending portion and the surface of the substrate is longer than at least 1 mm.

Further features of the present disclosure will become apparent from the following description of exemplary embodiments with reference to the attached drawings.

BRIEF DESCRIPTION OF THE DRAWINGS

FIG. 6A is a diagram illustrating the configuration of a heatsink of a comparative example.

FIG. 6B is a diagram illustrating the configuration of a heatsink according to an embodiment of the present disclosure.

FIG. 6C is a table in which the temperatures of individual points of the heatsinks are listed.

DESCRIPTION OF THE EMBODIMENTS

First Embodiment

[Configuration of Image Forming Apparatus]

The configuration of an image forming apparatus 100 according to this embodiment will be described. The image forming apparatus 100 of this embodiment is a monochrome laser printer using an electrophotographic process, which forms a toner (developer) image on paper P, which is a print medium, according to image information transmitted from an external apparatus, such as a personal computer.

In the following description, the height direction (the direction opposite to the vertical direction) of the image forming apparatus 100 disposed in a horizontal plane is referred to as Z-direction. The direction crossing the Z-direction and parallel to the direction of axis of the photosensitive drum 105 (the main scanning direction) is referred to as Y-direction. The direction crossing the Y-direction and the Z-direction is referred to as X-direction. The X-direction, Y-direction, Z-direction may cross at right angles. The plus side in the X-direction is referred to as "front side", the minus side is referred to as "back side", the plus side in the Y-direction is referred to as "right side", the minus side is referred to as "left side", the plus side in the Z-direction is referred to as "upper side", and the minus side is referred to as "lower side", for convenience.

Figure 1:
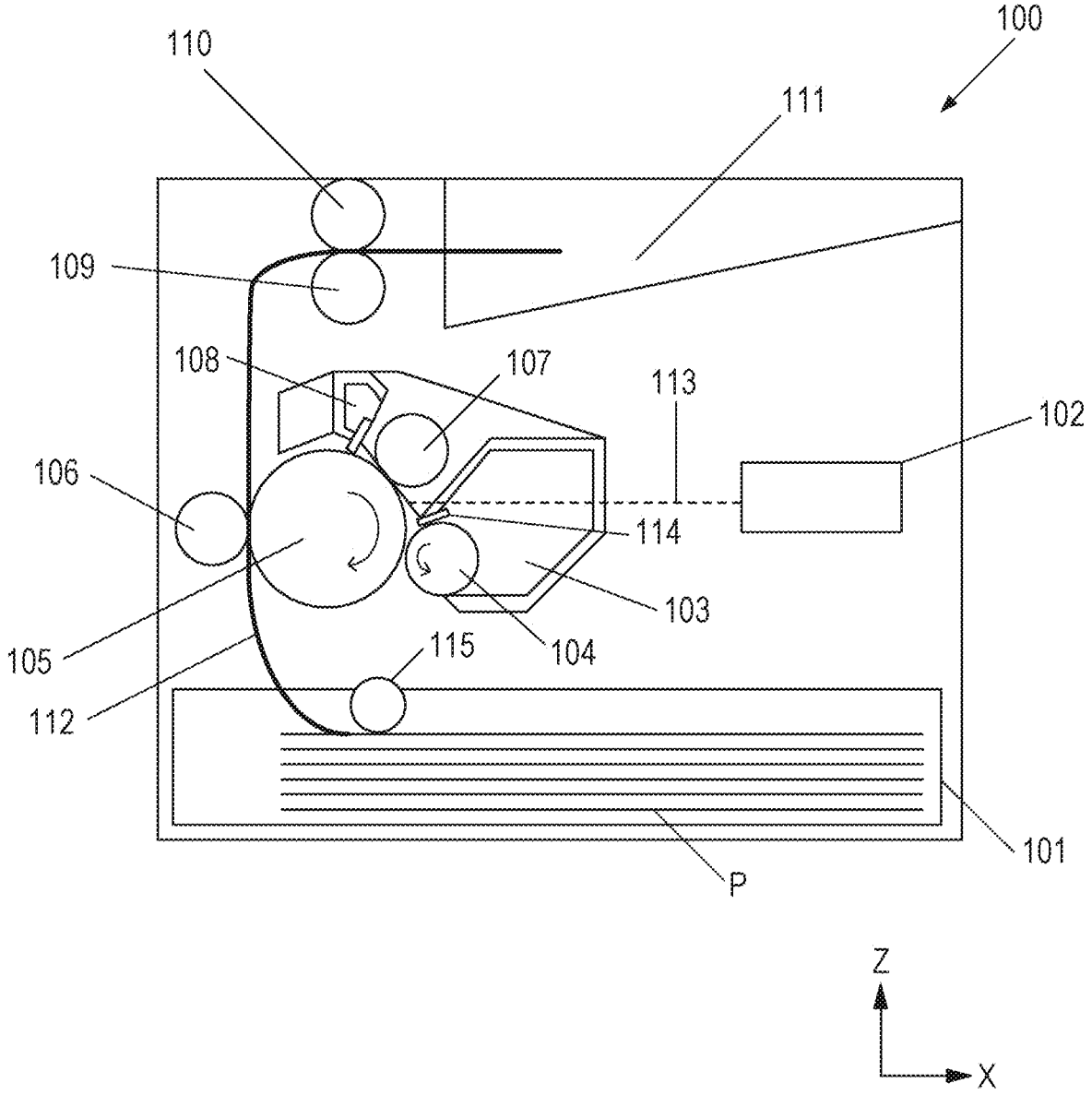
FIG. 1 is a cross-sectional view of an image forming apparatus according to an embodiment of the present disclosure.

FIG. 1 is a cross-sectional view of the image forming apparatus 100. In FIG. 1, reference sign 101 denotes a paper feeding unit that stores paper P to be printed, in which paper P is stacked. Reference sign 102 denotes a laser scanner, and 103 denotes a toner tank that contains magnetic toner. Reference sign 104 denotes a developing roller, 105 denotes a photosensitive drum, 106 denotes a transfer roller, 107 denotes a charging roller, 108 denotes a waste-toner tank, 109 denotes a fixing roller, and 110 denotes a pressure roller. Reference sign 111 denotes a paper ejection unit, 112 denotes a conveying path for paper P, 113 denotes a laser beam emitted from the laser scanner 102, 114 denotes a developing blade that regulates the amount of toner on the developing roller 104, and 115 denotes a paper feeding roller.

[Operation of Image Forming Apparatus]

The operation of the image forming apparatus 100 will be described. Upon receiving a print job, the individual rollers and the laser scanner 102 start to operate. The photosensitive drum 105 starts to rotate in the direction of arrow in FIG. 1. The charging roller 107 generates a negative high voltage by receiving power from the power supply apparatus 200 to electrically charge the surface of the photosensitive drum 105. When an image signal is sent from an external apparatus, the laser scanner 102 scans a laser beam while blinking according to the pixels. The charge of a portion of the charged surface of the photosensitive drum 105 irradiated with the laser beam 113 disappears to form an electrostatic latent image on the photosensitive drum 105.

The developing roller 104 is supplied with a negative high voltage and houses a magnet. The developing roller 104 attracts the magnetic toner in the toner tank 103 with a magnetic force to develop the electrostatic latent image on the photosensitive drum 105 with the toner. The developing blade 114 is given a potential difference of about several hundred volts from the developing roller 104, so that the toner on the developing roller 104 is uniformly coated by the physical regulation using the blade main body and also the electrostatic force.

The paper P fed from the paper feeding unit 101 by the paper feeding roller 115 is conveyed to a transfer nip formed by the transfer roller 106 and the photosensitive drum 105 through the conveying path 112. At that time, the transfer roller 106 is under a positive high voltage, so that the toner image formed on the photosensitive drum 105 is transferred to paper P by being drawn by the transfer roller 106.

The paper P to which the toner image is transferred is conveyed toward the paper ejection unit 111 through a fixing nip formed by the fixing roller 109 and the pressure roller 110. At the fixing nip, the paper P is heated to several hundred degrees by the fixing roller 109 and pressed by the pressure roller 110, so that the toner image, which is placed on the paper P only by the electrostatic force, is fixed. The paper P to which the toner image is fixed is discharged to the paper ejection unit 111, where the paper P is stacked one by one.

Some toner remains on the surface of the photosensitive drum 105 even after the transfer to the paper P is performed. Ideally, all the toner should be transferred to the paper P. Actually, some toner remains on the photosensitive drum 105 because the amount of charge of the toner is not uniform. The waste-toner tank 108 is a unit that collects the remaining toner scraped with a blade in contact with the photosensitive drum 105. This allows the toner on the photosensitive drum 105 to be removed. The photosensitive drum 105 is again electrically charged by the charging roller 107, and the next electrostatic latent image is formed by the laser scanner 102. The image forming apparatus 100 forms images on the paper P by repeating the above operation.

[Circuit Configuration of Power Supply Apparatus]

Figure 2:
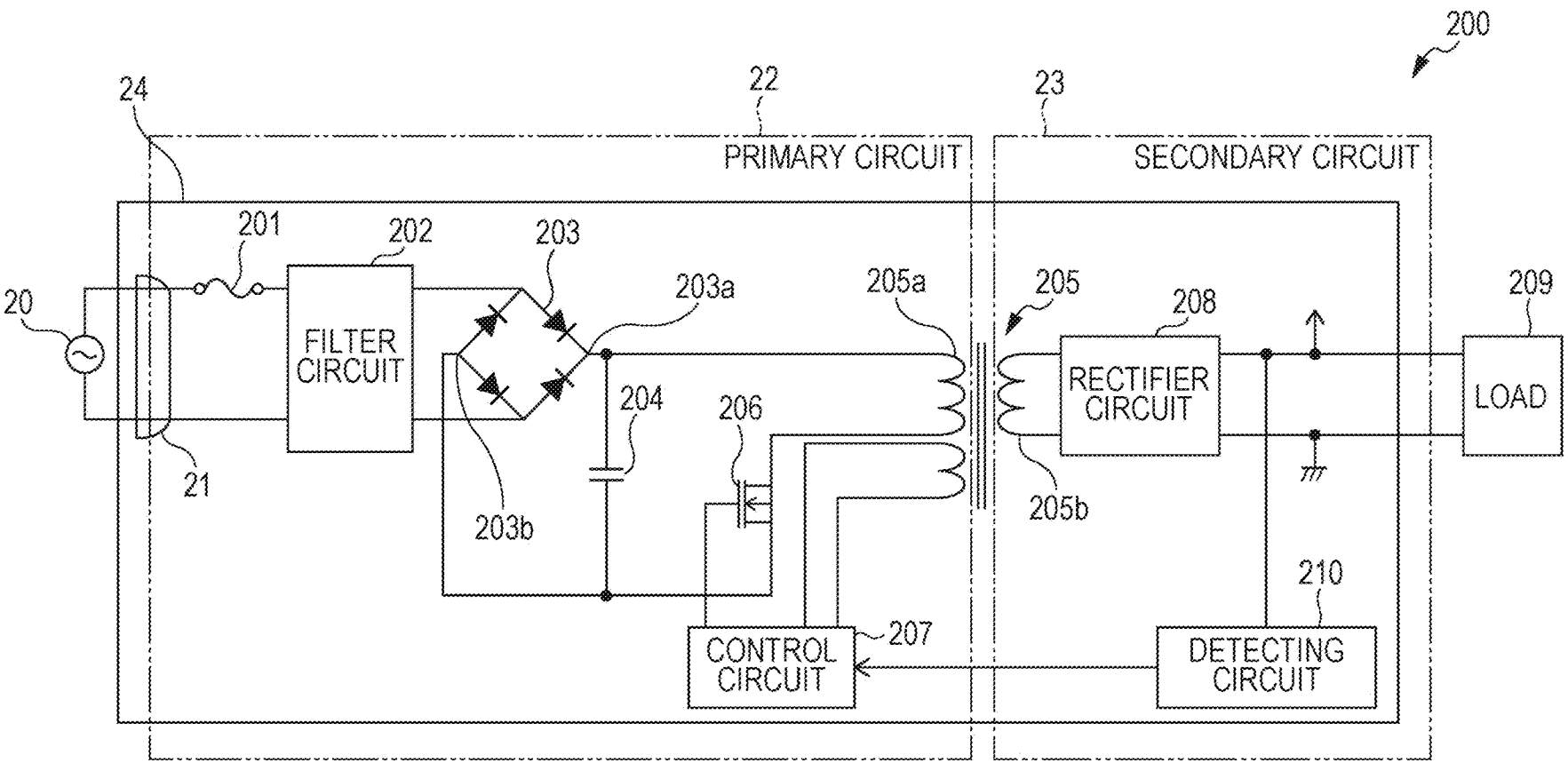
FIG. 2 is a circuit configuration diagram of a power supply apparatus installed in the image forming apparatus.

FIG. 2 is a circuit configuration diagram of a power supply apparatus 200 installed in the image forming apparatus 100. The image forming apparatus 100 uses various voltages in the operation process, as described above. The power supply apparatus 200 is used to convert an alternating current supplied from and external power supply to a direct current and to output the various voltages. As illustrated in FIG. 2, the power supply apparatus 200 includes a circuit (a primary circuit) 22 and a circuit (a secondary circuit) 23. The circuit 22 and the circuit 23 are formed of one printed circuit board 24 and are disposed on the same plane.

The circuit 22 includes an inlet 21, a fuse 201, a filter circuit 202, a rectifier circuit (a primary rectifier circuit) 203, an electrolytic capacitor 204, a switching element (a switching field-effect transistor (FET)) 206, and a control circuit 207. The circuit 23 includes a rectifier circuit (a secondary rectifier circuit) 208, and a detecting circuit 210. The power supply apparatus 200 further includes a transformer 205 including a primary coil 205*a* and a secondary coil 205*b*. The primary coil 205*a* belongs to the circuit 22, and the secondary coil 205*b* belongs to the circuit 23. The transformer 205 is however included in the circuit 22 as a whole.

The power supply apparatus 200A connects to a commercial alternating-current power supply 20 and is supplied with power through the inlet 21. The power supplied to the power supply apparatus 200 reaches the rectifier circuit 203 via the fuse 201 and the filter circuit 202. The rectifier circuit 203 is, for example, a diode bridge circuit including four diodes. The sinusoidal waveform of the alternating current input from the commercial alternating-current power supply 20 is rectified by the rectifier circuit 203 into a pulsating waveform. The input current with the pulsating waveform is smoothed by the electrolytic capacitor 204. In other words, the electrolytic capacitor 204 in this embodiment functions as a primary smoothing capacitor. The rectifier circuit 203 and the electrolytic capacitor 204 constitute a rectifying smoothing circuit.

The value of the smoothed input voltage becomes close to the peak voltage value of the input alternating-current voltage with the sinusoidal waveform. The smoothed input voltage is input to the transformer 205 via a plus terminal 203*a*, and the current returns to a minus terminal 203*b* via the switching element 206. The on-off timing of the switching element 206 is controlled by the control circuit 207. The supply power for the control circuit 207 is generated in the transformer 205.

The secondary coil 205*b* of the transformer 205 connects to the rectifier circuit 208. The power whose voltage is converted by the transformer 205 reaches the rectifier circuit 208, where it is rectified and smoothed to a predetermined voltage and is output to a load 209 outside the power supply apparatus 200. The output terminal of the rectifier circuit 208 is connected to the detecting circuit 210, so that the voltage output from the rectifier circuit 208 is input also to the detecting circuit 210. The value (the value of voltage output from the rectifier circuit 208) detected by the detecting circuit 210 is input to the control circuit 207. To provide isolation between the detecting circuit 210 (the secondary circuit 23) and the control circuit 207 (the primary circuit 22), the detecting circuit 210 and the control circuit 207 are connected via an isolating element, such as a photocoupler. The control circuit 207 determines the on-off timing of the switching element 206 on the basis of the detected value of the detecting circuit 210 input to the control circuit 207.

[Layout of Electronic Components]

Figure 3:
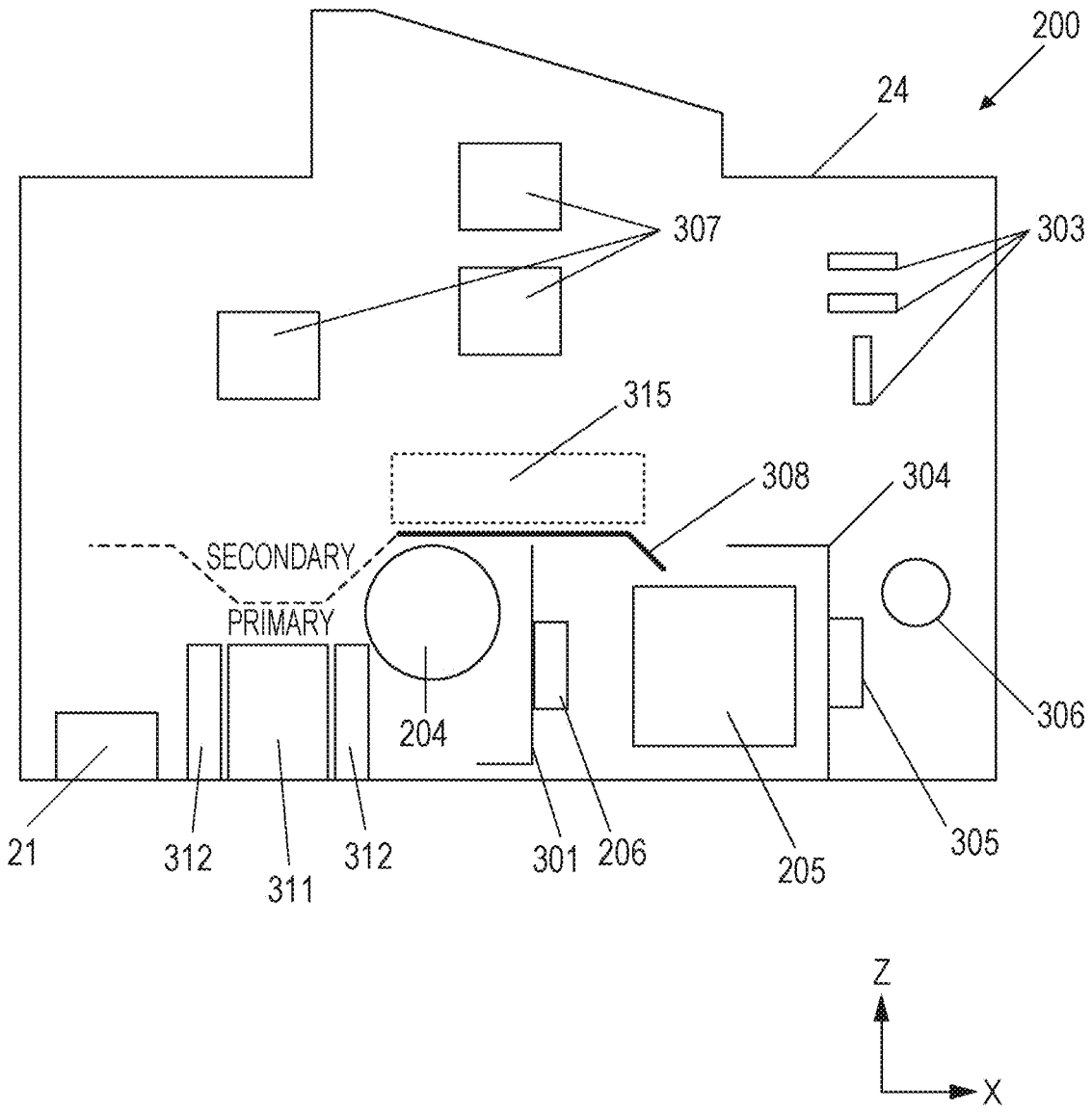
FIG. 3 is a top view of the image forming apparatus.

FIG. 3 is a diagram illustrating the layout of a plurality of electronic components of the power supply apparatus 200 when viewed in the direction perpendicular to the surface of the printed circuit board 24. FIG. 3 illustrates only relatively large electronic components. The power supply apparatus 200 of this embodiment includes not only the low-voltage supply circuit described with reference to FIG. 2 but also a high-voltage supply circuit that increases the direct current voltage output from the low-voltage supply circuit to generate various bias voltages on the same substrate. The low-voltage supply circuit and the high-voltage supply circuit not always have to be formed on the same substrate. The power supply apparatus 200 is disposed so that the surface of the printed circuit board 24 is perpendicular to the horizontal plane (vertically), and in this embodiment, the surface of the printed circuit board 24 is parallel to the X-Z plane, as shown in FIG. 3.

Figure 4A:
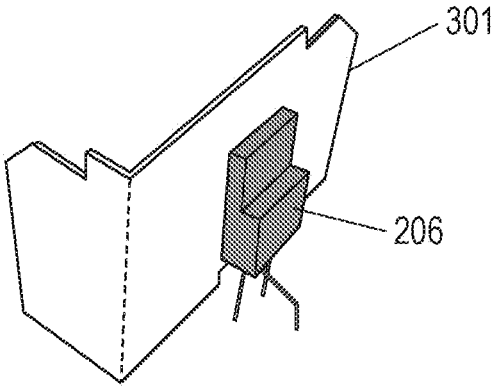
FIGS. 4A and 4B are diagrams illustrating the configuration of comparative examples.
Figure 4B:
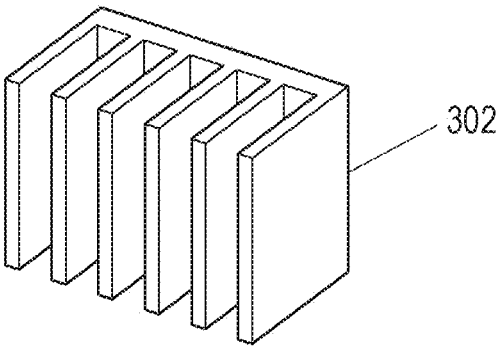

In FIG. 3, the same electronic components as those described in FIG. 2 are given the same reference signs, and descriptions thereof will be omitted here. A heatsink 301 is provided to radiate heat generated from an attached component. FIG. 4A is a perspective view of the heatsink 301. Since the switching element 206 is prone to generate heat, the switching element 206 is disposed in contact with the heatsink 301, as in FIG. 4A, to improve the heat radiation efficiency. Although this embodiment employs the heatsink 301 formed by bending an iron plate, as illustrated in FIG. 4A, a fin-shaped heatsink 302 illustrated in FIG. 4B may be employed.

In FIG. 3, a line filter 311 and an X capacitor 312 are provided to remove noise. The line filter 311 and the X capacitor 312 constitutes the filter circuit 202. Reference sign 304 denotes a heatsink provided on the secondary side, with the transformer 205 therebetween, 305 denotes a diode, and 306 denotes a smoothing capacitor. Since the diode 305 is prone to generate heat, the diode 305 is directly attached to the heatsink 304. The diode 305 and the smoothing capacitor 306 constitute the rectifier circuit 208.

Since the power supply apparatus 200 includes not only the low-voltage supply circuit but also the high-voltage supply circuit, as described above, the power supply apparatus 200 further includes high-voltage transformers 307 for applying high bias voltages to process members for charging, developing, and transfer. Connectors 303 are connected to various components with wire harnesses. The broken line 315 indicates a portion where a control circuit composed of chip parts is provided on the back of the printed circuit board 24. Reference sign 308 denotes a slit provided in the printed circuit board 24.

The power supply apparatus 200 of this embodiment is electrically separated into the primary side and the secondary side by the transformer 205. In FIG. 3, the power supply apparatus 200 is separated into the primary area (Primary) and the secondary area (Secondary), with the dotted line as the boundary. The primary area and the secondary area need to have a spatial distance or creepage distance specified by a standard therebetween. The standard is determined by individual countries based on International Electrotechnical Commission (IEC). Typical examples include Japanese Industrial Standards (JIS) and Underwriters Laboratories Inc. (UL) standards.

The spatial distance is the shorted distance between two points. The creepage distance is the length of the shortest path connecting two points along the surface of an object (for example, the surface of the printed circuit board 24). The "space" here is regard as "space" only when a slit larger than 1 mm is present. If the slit is 1 mm or less in size, even if it is actually 0.9 mm, the two points are considered to be connected in terms of the standard. Conversely, a slit even with 1.1 mm can be regarded as "space", that is, the points are physically separated.

Also for the creepage distance, providing the slit 308 larger than 1 mm between the primary area and the secondary area allows the primary area and the secondary area to be arranged next to each other, as shown in FIG. 3. In other words, if the electrolytic capacitor 204 and the heatsink 301 in the primary area and the chip parts 315 in the secondary area are near to each other, providing the slit 308 therebetween allows meeting the standard. Disposing the slit 308 requires to bypass the slit 308 when connecting the two points along the surface of the printed circuit board 24, thereby increasing the creepage distance.

[Configuration of Heatsink]

In FIG. 3, the heatsink 301 is within the primary area. Even if the heatsink 301 is to be increased in size to improve the heat radiation efficiency, there is no space in the primary area where the heatsink 301 can be expanded in the Z-direction. The heatsink 301 may be expanded in the Z-direction not in the X-direction or the Y-direction because heat has the property of going upward.

An actual study on the heat distribution of the heatsink 301 shows that an upper portion in the Z-direction is hotter than a lower portion (the details will be described later). For this reason, the portion of the heatsink 301 higher in the Z-direction than the switching element 206, which is a heat generator, is desirably large. The switching element 206, however, often cannot be easily moved because of the circuit pattern, and the heatsink 301 cannot be expanded because of the slit 308 disposed above the heatsink 301.

Figure 5:
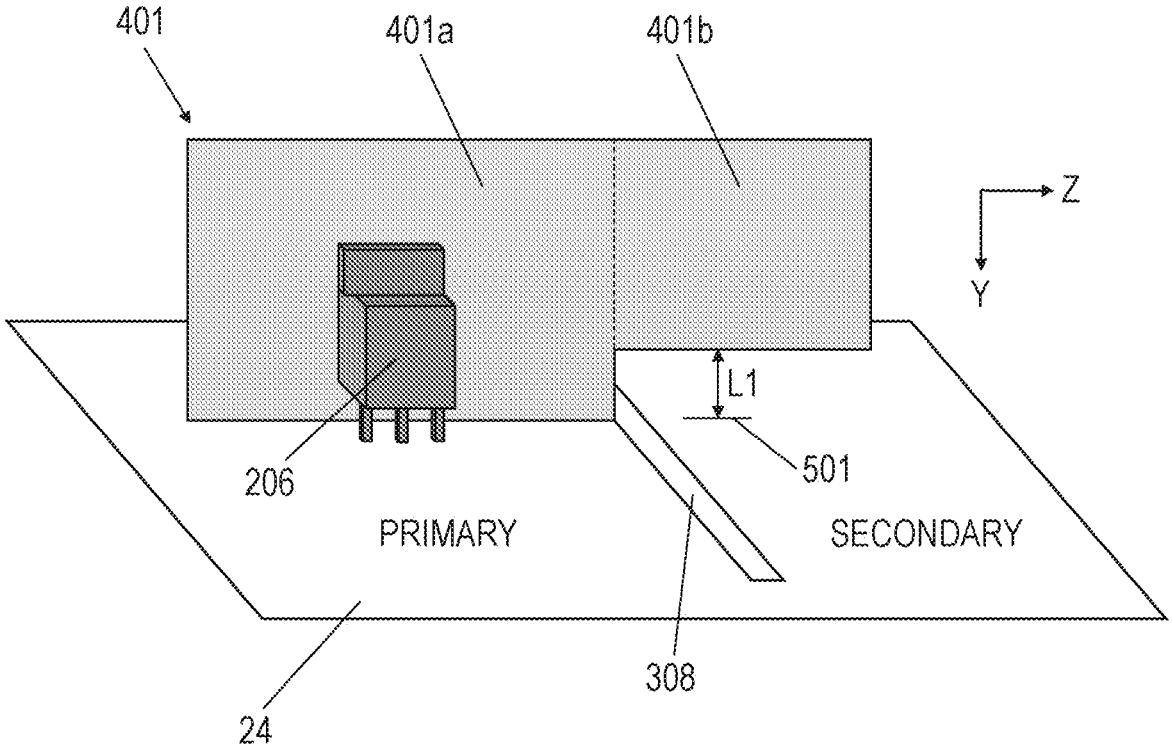
FIG. 5 is a diagram illustrating the configuration of an embodiment of the present disclosure.

FIG. 5 is a perspective view of a heatsink 401 of this embodiment to address the above, illustrating the configuration thereof. FIG. 5 illustrates only part of the printed circuit board 24 and components around the heatsink 401. The heatsink 401 of this embodiment includes a protruding portion 401*a* protruding from the position in contact with the printed circuit board 24 in a direction protruding from the surface of the printed circuit board 24 (in the Y-axis minus direction) and an extending portion 401*b* extending from part of the protruding portion 401*a* to the secondary area, in a state spaced apart from the printed circuit board 24.

The heatsink 401 is in contact with the primary area of the printed circuit board 24 at the protruding portion 401*a* and is supported by the printed circuit board 24. The extending portion 401*b* extends in the Z-axis plus direction into the secondary area across the slit 308. The extending portion 401*b* is not in contact with the printed circuit board 24 and is kept apart from the surface of the printed circuit board 24 so as to satisfy the standard. Specifically, a distance L1 in the Z-direction between a position 501 of the surface of the printed circuit board 24 to which the extending portion 401*b* is projected and an end of the extending portion 401*b* is longer than 1 mm.

The distance L1 longer than 1 mm can be regarded as "space" in terms of the safety standard. This method provides isolation from the secondary circuit even if the heatsink 401 extends over the secondary circuit. Furthermore, the increase in the area (on the Z-axis plus side) of the heatsink 401 higher than the switching element 206, which is a heat generating source, remarkably increases the heat radiation effect.

FIGS. 6A to 6C illustrate experimental results that show the difference in heat radiation effect between a comparative example and this embodiment. FIG. 6A illustrates the configuration of the heatsink 301 of the comparative example. FIG. 6B illustrates the configuration of the heatsink 401 of this embodiment. FIG. 6C shows a table in which the temperatures of individual points of the heatsinks 301 and 401 are listed.

The experiments were performed, with the power supply apparatus 200 attached to the image forming apparatus 100. The saturation temperature of the heat generating source (the switching element 206) and the temperatures of the heatsinks 301 and 401 at that time were measured at a constant current drawn from the low-voltage supply circuit. As is shown in FIG. 6C, the measured temperatures increased toward a higher portion (to the Z-axis plus side) in the configuration of the comparative example. With the configuration of FIG. 6A, the temperature of the thermometric point 4 was 66.4 degrees, while the temperature of the thermometric point 1 was 77.6 degrees.

With the configuration of FIG. 6A, the temperature of the heat generating source (the switching element 206) was 82.9 degrees at the thermometric point 2, and with the configuration of FIG. 6B, the temperature of the thermometric point 3 was 79 degrees. In other words, the temperature of the switching element 206 could be decreased by about 4 degrees from the comparative example. This may be because the area of the heatsink 401 above the heat generating source increased, thereby improving the heat radiation efficiency.

The configuration in FIG. 6B is such that the lower bent portion in FIG. 6A is unbent upward, and the amount of the material used is the same. In other words, the heat radiation efficiency could be increased without increasing the cost.

Thus, this embodiment achieves increasing the size of the heatsink without increasing the area of the substrate, thereby improving the heat radiation efficiency of the electronic component.

Figure 7:
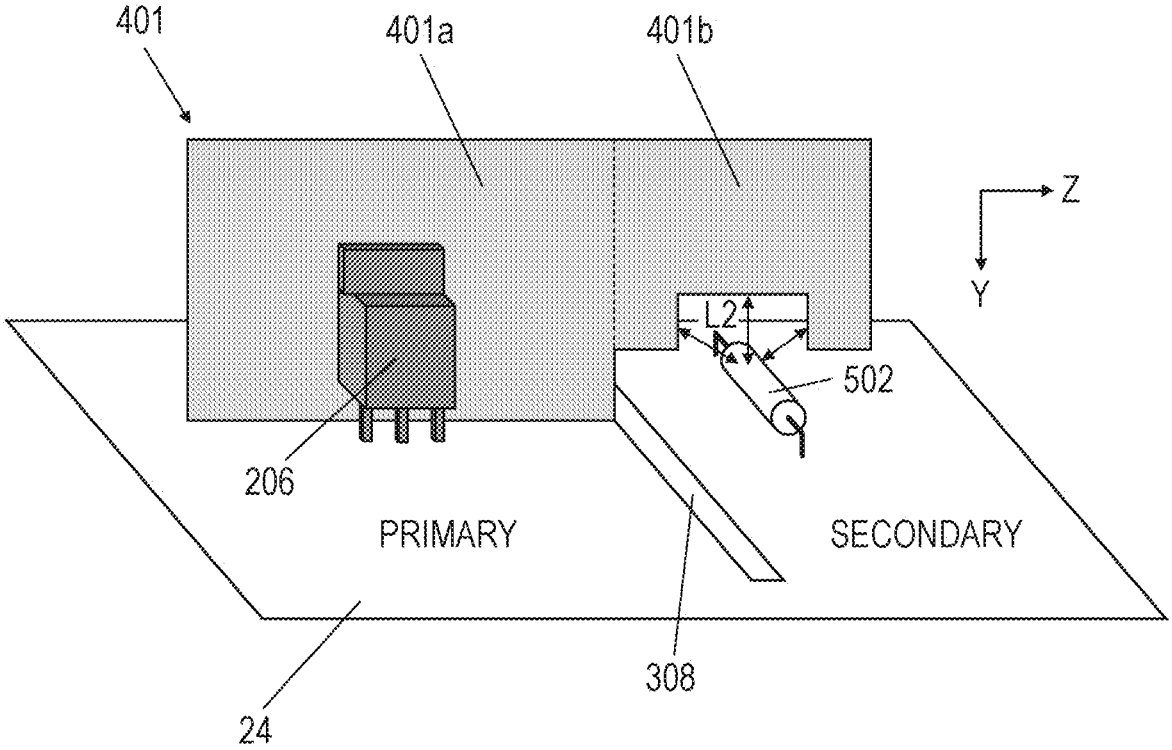
FIG. 7 is a diagram illustrating the configuration of a modification of the present disclosure.

The above embodiment is an example in which no electronic component is attached to the position 501 of the surface of the printed circuit board 24 to which the extending portion 401*b* is projected. The present disclosure is not limited to this example. As illustrated in FIG. 7, an electronic component, such as a lead resistor 502, may be provided at the position. The electronic component is not limited to the above but may be a diode, a capacitor, or a jumper lead.

In the case where the extending portion 401*b* crosses the lead resistor 502, as shown in FIG. 7, the end of the extending portion 401*b* needs more than 1 mm away from the outer shape of the lead resistor 502. Specifically, the distance L2 between the outer shape of the lead resistor 502 and the end of the extending portion 401*b* in a Y-Z plane is longer than 1 mm.

Furthermore, the heatsink 401 in the above embodiment has a straight shape extending in the Z-direction. However, the present disclosure is not limited to the straight shape. The heatsink may include the extending portion 401*b* extending to the secondary circuit while having the bent portion shown in FIG. 6A. The bent portion shown in FIG. 6A allows the heatsink 401 to be stably supported on the printed circuit board 24.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-197070, filed Nov. 27, 2020, which is hereby incorporated by reference herein in its entirety.

What is claimed is:

1. A power supply apparatus comprising:

a transformer including a primary coil and a secondary coil and configured to output a voltage to the secondary coil according to a voltage input to the primary coil;

a heatsink configured to radiate heat of the power supply apparatus; and a substrate including a primary circuit with the primary coil and a secondary circuit with the secondary coil on the same plane, wherein the substrate is in contact with the heatsink in an area of the primary circuit to support the heatsink, wherein the heatsink includes a protruding portion protruding from a position where the heatsink is in contact with the substrate in a direction protruding from a surface of the substrate and an extending portion extending from part of the protruding portion to an area of the secondary circuit of the transformer, in a state spaced apart from the substrate, and wherein the extending portion enters the area of the secondary circuit when viewed in a direction perpendicular to the surface of the substrate, and a distance between the extending portion and the surface of the substrate is longer than at least 1 millimeter (mm).

2. The power supply apparatus according to claim 1, further comprising:

a rectifying smoothing circuit configured to convert an alternating current supplied from an external power supply to a direct current; and a switching element in contact with the protruding portion of the heatsink and configured to switch on and off of supply of the direct current output from the rectifying smoothing circuit to the primary coil.

3. The power supply apparatus according to claim 1, wherein, when an electronic component is provided in the area of the secondary circuit, a distance between the extending portion and the electronic component is longer than at least 1 mm.

4. The power supply apparatus according to claim 1, wherein the substrate has a slit larger than 1 mm between the primary circuit and the secondary circuit, and wherein the extending portion enters the area of the secondary circuit across the slit.

5. An image forming apparatus comprising:

an image forming unit configured to form an image on a recording medium; and a power supply apparatus configured to supply power to the image forming unit, wherein the power supply apparatus includes:

a transformer including a primary coil and a secondary coil and configured to output a voltage to the secondary coil according to a voltage input to the primary coil, a heatsink configured to radiate heat of the power supply apparatus, and a substrate including a primary circuit with the primary coil and a secondary circuit with the secondary coil on the same plane, wherein the substrate is in contact with the heatsink in an area of the primary circuit to support the heatsink, wherein the heatsink includes a protruding portion protruding from a position where the heatsink is in contact with the substrate in a direction protruding from a surface of the substrate and an extending portion extending from part of the protruding portion to an area of the secondary circuit of the transformer, in a state spaced apart from the substrate, and wherein the extending portion enters the area of the secondary circuit when viewed in a direction perpendicular to the surface of the substrate, and a distance between the extending portion and the surface of the substrate is longer than at least 1 millimeter (mm).

6. The image forming apparatus according to claim 5, wherein the power supply apparatus further includes:

a rectifying smoothing circuit configured to convert an alternating current supplied from an external power supply to a direct current, and a switching element in contact with the protruding portion of the heatsink and is configured to switch on and off of supply of the direct current output from the rectifying smoothing circuit to the primary coil.

7. The image forming apparatus according to claim 5, wherein, when an electronic component is provided in the area of the secondary circuit, a distance between the extending portion and the electronic component is longer than at least 1 mm.

8. The image forming apparatus according to claim 5, wherein the substrate has a slit larger than 1 mm between the primary circuit and the secondary circuit, and wherein the extending portion enters the area of the secondary circuit across the slit.

9. The image forming apparatus according to claim 5, wherein the power supply apparatus is disposed such that the surface of the substrate is perpendicular to a horizontal plane.

10. The image forming apparatus according to claim 9, wherein the secondary circuit is disposed on the substrate and is disposed vertically above the primary circuit, and wherein the extending portion of the heatsink extends vertically upward.

11. The image forming apparatus according to claim 5, further comprising:

a charging unit configured to electrically charge a surface of a photosensitive drum;

a developing unit configured to develop a toner image on the photosensitive drum with toner; and a transfer unit configured to transfer the toner image formed on the photosensitive drum to the recording medium, wherein the charging unit, the developing unit, and the transfer unit are individually supplied with electric power from the secondary circuit.

12. A power supply apparatus for an image forming apparatus, the power supply apparatus comprising:

a substrate having a primary area that includes a primary circuit and a secondary area that is separated from the primary area in that the secondary area does not include the primary circuit;

an electronic element prone to generating heat in response to control from a control circuit; and a heatsink provided on a front of the substrate in the primary area and having a protruding portion that protrudes away from the substrate, wherein the electronic element is disposed to allow the heatsink to radiate heat away from the electronic element, wherein the heatsink further includes an extending portion that extends into the secondary area of the substrate at a distance above the secondary area, and wherein the distance above the secondary area has a value that is equal to or greater than a spatial distance for a slit having material removed to define a space in compliance with a standard that is based on an International Electrotechnical Commission (IEC) standard.

13. The image forming apparatus according to claim 12, wherein the secondary area includes a control circuit composed of chip parts that are provided on a back of the substrate that is a side opposite to the front of the substrate, and wherein the chip parts are provided at a distance from the heatsink that is equal to or greater than the distance above the secondary area, and the electronic element is a switching element prone to generating heat when returning current to a terminal of a rectifier circuit as determined by on-off timing from the control circuit.

14. The image forming apparatus according to claim 12, wherein a slit is disposed through the substrate and the extending portion extends from the protruding portion over the slit and then into the secondary area of the substrate without contacting the secondary area, and wherein both a width of the slit and the distance of the extending portion above the secondary area are each larger than 1 millimeter (mm).

15. The image forming apparatus according to claim 12, wherein the substrate is a printed circuit board, the secondary area includes a secondary circuit connected to the primary circuit through a transformer, the spatial distance for the slit is the shortest distance between two points that are considered not to be connected in terms of the standard, and the standard that is based on the International Electrotechnical Commission (IEC) standard is one of a Japanese Industrial Standards (JIS) and an Underwriters Laboratories Inc. (UL) standard.

16. The image forming apparatus according to claim 12, wherein an electronic component is provided in the secondary area at a position that is adjacent to where the extending portion of the heatsink extends above the secondary area, and wherein a distance between an outer shape of the electronic component and an end of the extending portion is equal to or greater than the distance above the secondary area.

17. The image forming apparatus according to claim 16, wherein the electronic component is one of a lead resistor, a diode, a capacitor, or a jumper lead.

18. The image forming apparatus according to claim 12, wherein the heatsink includes a lower bent portion to stably support the heatsink on the substrate.

* * * * *